US006786674B1

(12) United States Patent
Hanks

(10) Patent No.: US 6,786,674 B1
(45) Date of Patent: Sep. 7, 2004

(54) CUSHIONED SURFACE STRUCTURE AND METHODS FOR MAKING THE SAME

(76) Inventor: Daniel B. Hanks, 7753 NW. Poplar Dr., Redmond, OR (US) 97756

( * ) Notice: Subject to any disclaimer, the term of this patent is extended or adjusted under 35 U.S.C. 154(b) by 0 days.

(21) Appl. No.: 10/121,837

(22) Filed: Apr. 11, 2002

Related U.S. Application Data

(60) Provisional application No. 60/284,410, filed on Apr. 16, 2001.

(51) Int. Cl.[7] ..... E01C 13/00
(52) U.S. Cl. ..... 404/32; 404/82
(58) Field of Search ..... 404/31, 32, 89, 404/81, 82; 428/17

(56) References Cited

U.S. PATENT DOCUMENTS

| | | | | |
|---|---|---|---|---|
| 2,042,377 A | | 5/1936 | Bamber | 428/454 |
| 4,172,168 A | * | 10/1979 | Klaffke et al. | 428/138 |
| 4,336,286 A | * | 6/1982 | Tomarin | 428/17 |
| 4,396,653 A | * | 8/1983 | Tomarin | 428/17 |
| 4,497,853 A | * | 2/1985 | Tomarin | 428/17 |
| 4,606,963 A | | 8/1986 | Farrell | 428/150 |
| 4,708,516 A | * | 11/1987 | Miller | 404/31 |
| 4,897,302 A | | 1/1990 | Bull | 442/395 |
| 5,352,158 A | | 10/1994 | Brodeur, Jr. | 472/92 |
| 5,411,352 A | | 5/1995 | Eren | 404/31 |
| 5,487,526 A | * | 1/1996 | Hupp | 404/89 |
| 5,678,951 A | * | 10/1997 | Levasseur | 404/17 |
| 5,883,182 A | | 3/1999 | Hunt | 524/525 |
| 5,958,527 A | * | 9/1999 | Prevost | 428/17 |
| 6,071,039 A | | 6/2000 | Ogura et al. | 404/32 |
| 6,299,959 B1 | * | 10/2001 | Squires et al. | 428/17 |
| 6,472,041 B1 | * | 10/2002 | Burke | 428/17 |
| 6,527,889 B1 | * | 3/2003 | Paschal et al. | 428/96 |
| 6,551,689 B1 | * | 4/2003 | Prevost | 428/143 |

* cited by examiner

*Primary Examiner*—Thomas B. Will
*Assistant Examiner*—Tara L. Mayo
(74) *Attorney, Agent, or Firm*—Klarquist Sparkman LLP

(57) ABSTRACT

A cushion surface structure, such as for a tennis court, is disclosed. In an exemplary embodiment, the surface structure includes one or more elastomeric layers comprising elastomeric particles, such as ground tire rubber, applied to a base surface. The elastomeric layers may comprise either loose elastomeric particles, or a matrix of elastomeric particles and an adhesive binder. To fill the voids of the elastomeric layers and provide a smooth, flat playing surface, one or more fill layers of dry fill material, such as silica sand, may be formed over the elastomeric layers. A color-fill system may be applied over the top fill layer, and one or more layers of a color mix may be applied over the color-fill system.

51 Claims, 8 Drawing Sheets

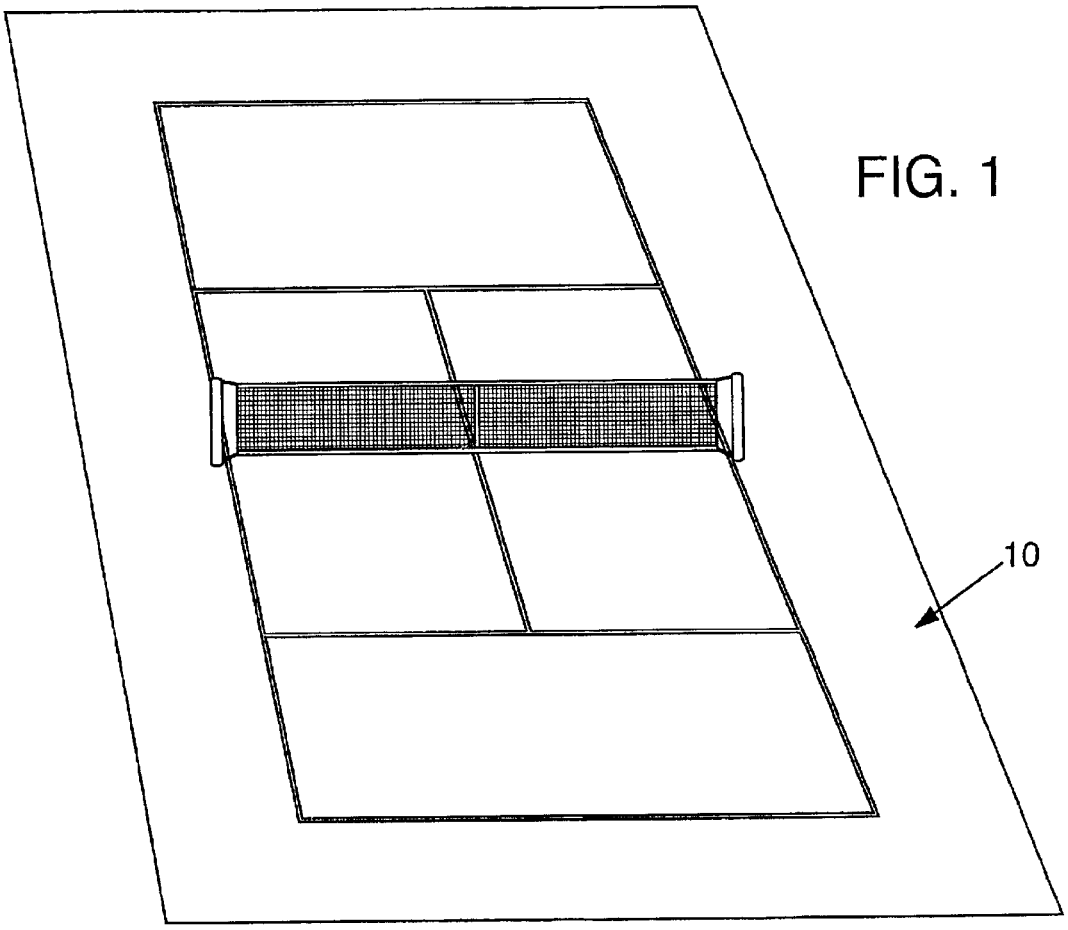
FIG. 1
FIG. 4
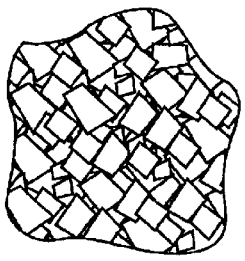
FIG. 5
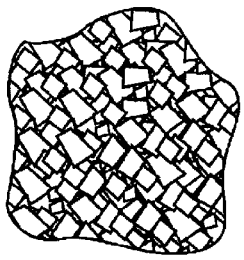
FIG. 6
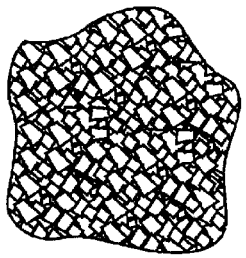

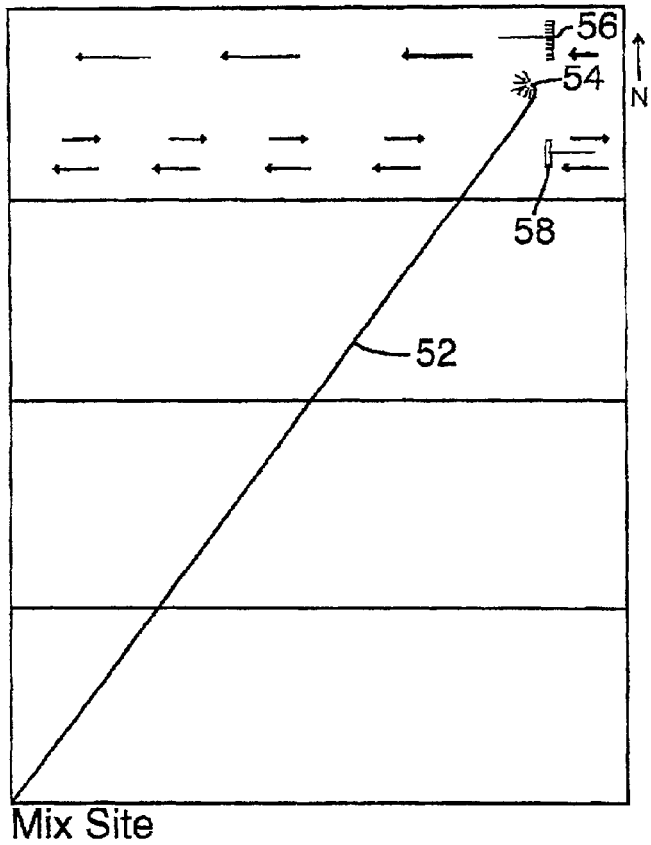
FIG. 11
FIG. 12
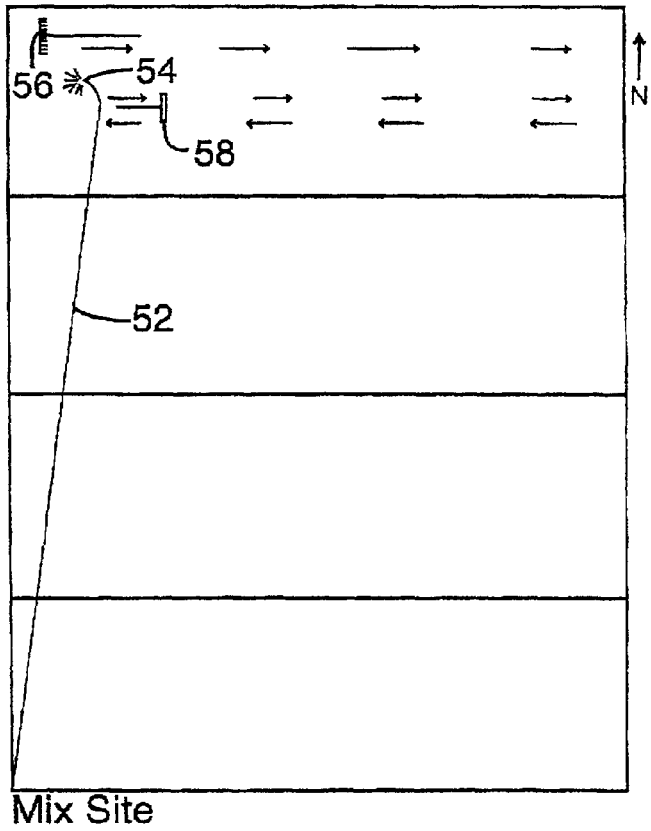

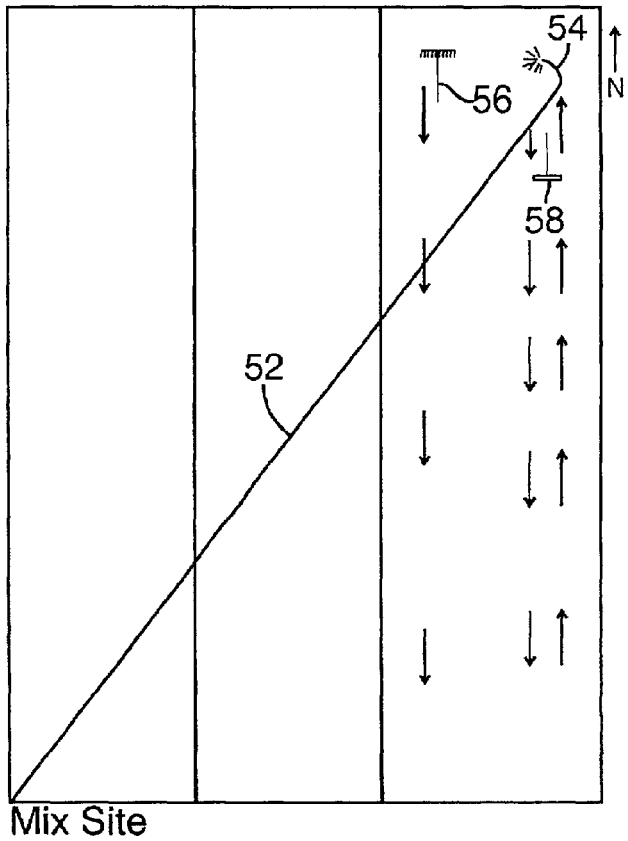
FIG. 13
FIG. 14
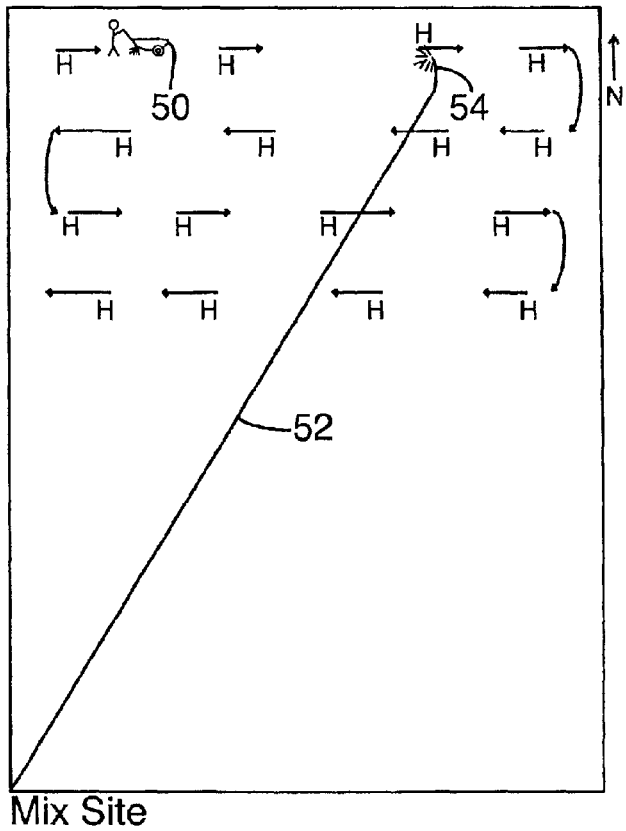

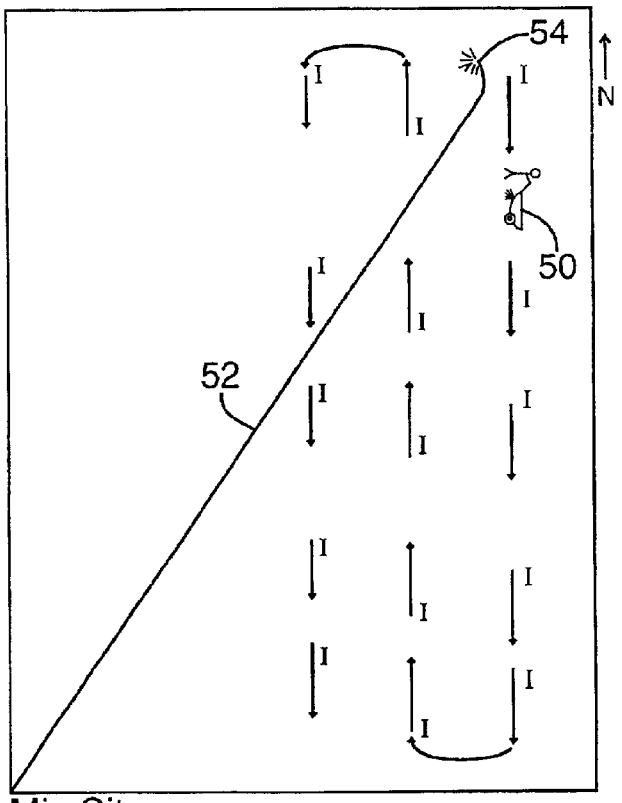
FIG. 15 Mix Site
FIG. 16
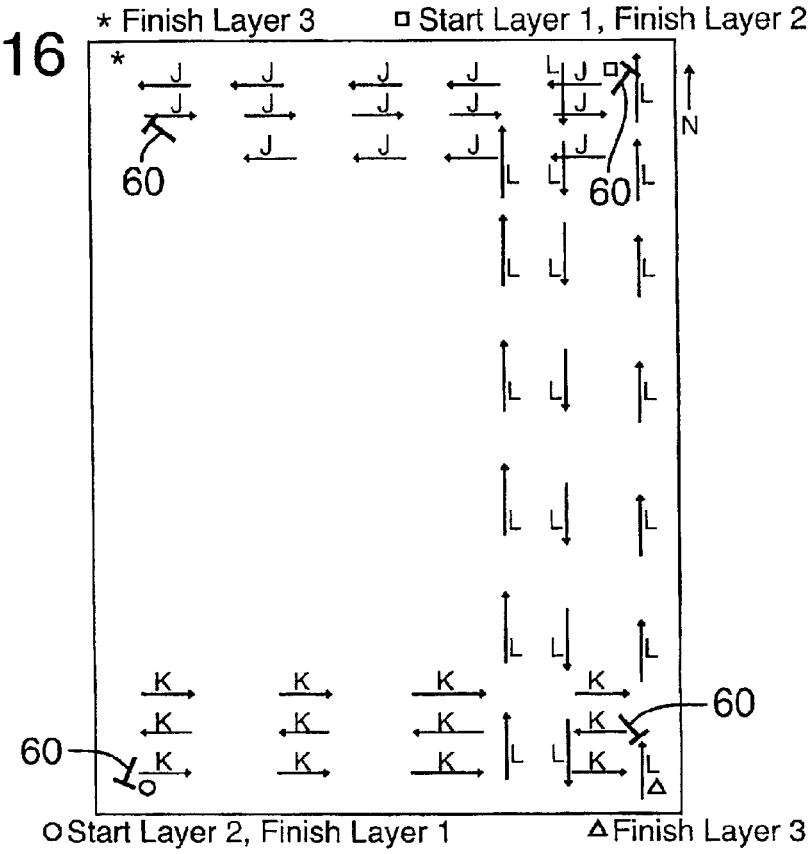

CUSHIONED SURFACE STRUCTURE AND METHODS FOR MAKING THE SAME

CROSS-REFERENCE TO RELATED APPLICATION

This application claims priority to U.S. Provisional Application No. 60/284,410, filed on Apr. 16, 2001.

FIELD

The present invention relates to a cushioned surface structure, such as for a tennis court.

BACKGROUND

Current tennis court surfaces generally fall under three categories: grass or lawn type surfaces; compacted clay surfaces; and hard surfaces. These surfaces are different in appearance and playing characteristics. For example, grass courts are characterized by a very fast surface that enhances the speed of a tennis game. However, these court surfaces are expensive to install and maintain and may cause erratic ball behavior. Grass courts also suffer from the disadvantage that they are seasonal.

Clay courts are characterized by a soft, spin receptive surface which induces slow play and helps reduce player injuries. However, clay courts require high maintenance and are also limited to seasonal use because of weather conditions.

Hard court surfaces generally include an asphalt or concrete base painted over with, for example, an acrylic latex water based emulsion. Hard court surfaces are the most common surfaces for tennis courts because they require very little maintenance and are not limited to seasonal use such as with grass and clay surfaces. However, hard court surfaces are the least forgiving of all court surfaces and may cause joint, ligament and/or tendon damage to players. Hard court surfaces are also disadvantageous in that they cause excessive wear to shoes and tennis balls, typically cause a tennis ball to bounce too high, and are not spin receptive enough to reward a good tennis shot.

Attempts have been made to produce a court surface that combines the soft and forgiving nature of clay or grass courts with the advantages of hard courts, such as wearability and low maintenance. For example, elastomeric compositions applied over concrete or asphalt surfaces are commonly used in the new construction of tennis courts to increase the resiliency of the playing surface. In one such approach, for example, a base layer of liquid polyurethane containing resilient material, such as pulverized rubber, is applied over a prepared surface of concrete, asphalt, timber, compacted earth or the like. A conventional tennis court coating, such as a color-fill coating, is typically applied over the base layer to provide a smooth, flat surface.

Most state-of-the-art surfaces that utilize elastomeric compositions suffer a number of disadvantages. For example, polyurethane/rubber surfaces, such as described above, are extremely expensive due to the high polyurethane content. In addition, the base layer of elastomeric particles is extremely porous, and therefore absorbs a significant amount of coating material as it is applied over the base layer. Consequently, an unusually large amount of coating material is required to fill the voids of the base layer and provide a smooth exposed surface. It is readily appreciated that the high cost of conventional coating materials can be prohibitive.

Thus, a need exists for a new and improved cushioned surface structure, such as for a tennis court, and methods for making the same.

SUMMARY

The present invention concerns a cushioned surface that has particular applicability to sport surfaces such as tennis courts, although the surface may be used in other applications as well. Other applications may include, for example, basketball courts, weight rooms, racquetball courts, tracks, garage floors, driveways and other surfaces.

Generally speaking, the surface includes one or more elastomeric layers comprising elastomeric particles, such as ground tire rubber, applied to a base surface such as concrete or asphalt. The elastomeric layers may comprise either loose elastomeric particles, or a matrix of elastomeric particles and an adhesive binder. Each elastomeric layer may be adhesively secured to an adjacent layer with a suitable adhesive, such as an acrylic binder.

To fill the voids of the elastomeric layers and provide a smooth, flat playing surface, one or more fill layers may be formed over the elastomeric layers. The fill layers desirably consist of a dry fill material, such as silica sand. A tennis court coating-compound, such as a color-fill system, may be applied over the top fill layer. Finally, one or more layers of a color mix may be applied over the color-fill system.

Using one or more fill layers to fill the voids in the elastomeric layers prior to the application of the coating-compound is advantageous because the fill layer(s) prevent the coating-compound from being absorbed into the elastomeric layers. Consequently, this reduces the amount of coating-compound that is required, which in turn reduces the overall installation cost of the court.

More specifically, a cushioned surface structure according to one representative embodiment comprises at least one elastomeric layer comprising at least 5% by weight of elastomeric particles, and more desirably, at least 50% by weight of elastomeric particles. At least one fill layer consisting of dry fill material, such as dry silica sand, overlays the first layer and fills the voids between the elastomeric particles. Although not required, white silica sand is preferred because its ability to reflect light facilitates the identification of surface imperfections in the fill layer. An adhesive layer comprising, for example, an acrylic binder, may be applied on top of each layer of the surface structure to bond together adjacent layers.

The surface structure also may include a conventional tennis court coating-compound layer, such as a color-fill layer, overlaying the fill layer, and a color-coating layer overlaying the coating-compound layer.

In particular embodiments, the surface structure comprises at least a lower elastomeric layer comprised entirely of loose elastomeric particles and at least an upper elastomeric layer comprising a matrix of elastomeric particles and a binder. Desirably, the elastomeric particles of the lower elastomeric layer are generally larger in size than the elastomeric particles of the upper elastomeric layer. Also, the lower and upper elastomeric layers desirably are formed such that the density of elastomeric particles in the lower layer is greater than the density of elastomeric particles in the upper elastomeric layer.

In addition, where more than one fill layer is used, the particle size of the fill material desirably is greatest in the lowermost fill layer, and the particle size decreases in one or more succeeding upper layers. In one disclosed embodiment, for example, two fill layers of #30 silica sand are applied over the elastomeric layers and two fill layers of #70 silica sand are applied over the fill layers of #30 silica sand.

According to another representative embodiment, a cushioned surface structure comprises at least one elastomeric layer comprising elastomeric particles. A first fill layer consisting of dry fill material overlays the elastomeric layer and a second fill layer consisting of dry fill material overlays the first fill layer. Desirably, the particle size of the fill material of the first fill layer is generally larger than the particle size of the fill material of the second fill layer.

A cushioned surface structure according to yet another representative embodiment comprises a first elastomeric layer of elastomeric particles and a second elastomeric layer of elastomeric particles overlaying the first elastomeric layer. Desirably, the elastomeric particles of the first elastomeric layer are generally larger in size than the elastomeric particles of the second elastomeric layer. In addition, at least one of the first and second elastomeric layers desirably comprises a matrix of elastomeric particles mixed in an adhesive binder. At least one fill layer of dry fill material for filling the voids in the elastomeric layers may be applied over the elastomeric layers.

According to another representative embodiment, a method of forming a cushioned surface structure includes forming at least one elastomeric layer comprising at least 5% by weight of elastomeric particles. At least one fill layer, consisting of dry fill material, such as dry silica sand, is applied over the elastomeric layer to fill in the voids between the elastomeric particles.

Another method of forming a cushioned surface structure includes applying at least a lower elastomeric layer of elastomeric particles over a sub-surface, and applying at least an upper elastomeric layer of elastomeric particles over the lower elastomeric layer. At least one fill layer is applied over the upper elastomeric layer for filling the voids of the elastomeric layers.

These and other features of the invention will be more fully appreciated when the following detailed description of the invention is read in conjunction with the accompanying drawings.

BRIEF DESCRIPTION OF THE DRAWINGS

FIG. 1 is a perspective view of a completed tennis court having a cushioned playing surface.

FIG. 4 is a partial, magnified view of a rubber layer having 1 to 3 mm ground rubber particles.

FIG. 5 is a partial, magnified view of a rubber/acrylic mix layer having 1 to 3 mm rubber particles.

FIG. 6 is a partial, magnified view of a rubber/acrylic mix layer having 0.5 to 1.5 mmn rubber particles.

FIG. 11 is a top schematic view illustrating the application of still another spray coating of acrylic binder and a rubber/acrylic binder mix to form the fourth rubber layer of the tennis court.

FIG. 12 is a top schematic view illustrating, the application of another spray coating of acrylic binder and a rubber/acrylic binder mix to form the fifth rubber layer of the tennis court.

FIG. 13 is a top schematic view illustrating the application of another spray coating of acrylic binder and a rubber/acrylic binder mix to form the sixth rubber layer of the tennis court.

FIG. 14 is a top schematic view illustrating the application of the seventh and eighth layers, each of which comprises a spray coating of acrylic binder and a layer of silica sand.

FIG. 15 is a top schematic view illustrating the application of the ninth and tenth layers, each of which also comprises a spray coating of acrylic binder and a layer of silica sand.

FIG. 16 is a top schematic view showing the application of the color-fill coating-system.

DETAILED DESCRIPTION

Figure 2:
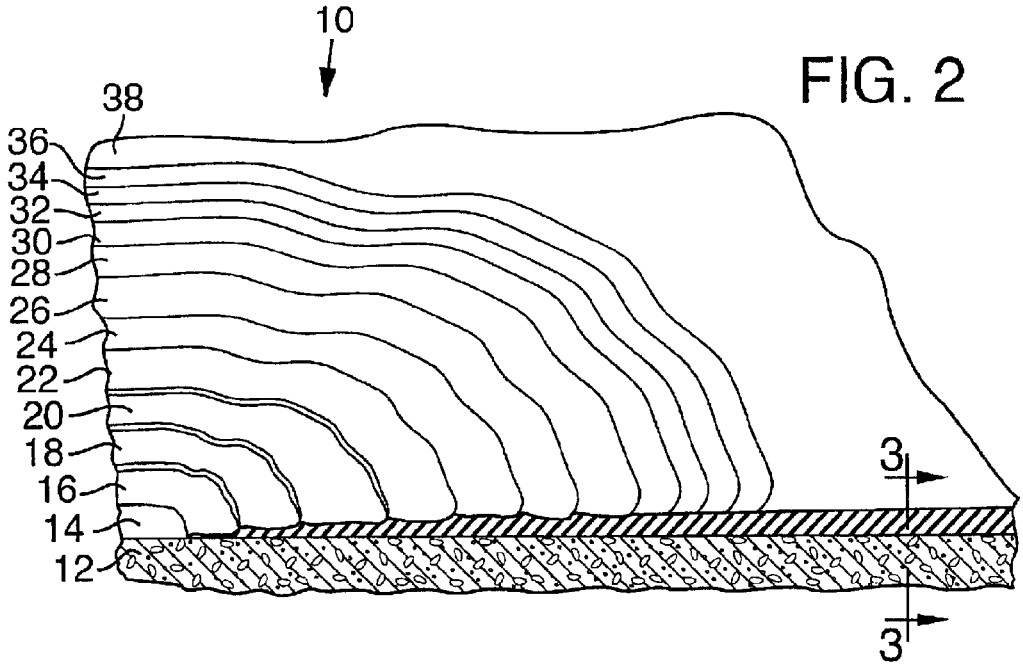
FIG. 2 is a perspective, cross-sectional view of the playing surface of FIG. 1.

Referring to the drawings, there is illustrated one embodiment of a cushioned surface structure for a tennis court. Although the following g description proceeds in reference to a tennis court, the surface structure may be used in other applications. Other applications may include, for example, basketball courts, weight rooms, racquetball courts, tracks, garage floors, driveways and other surfaces.

Figure 3:
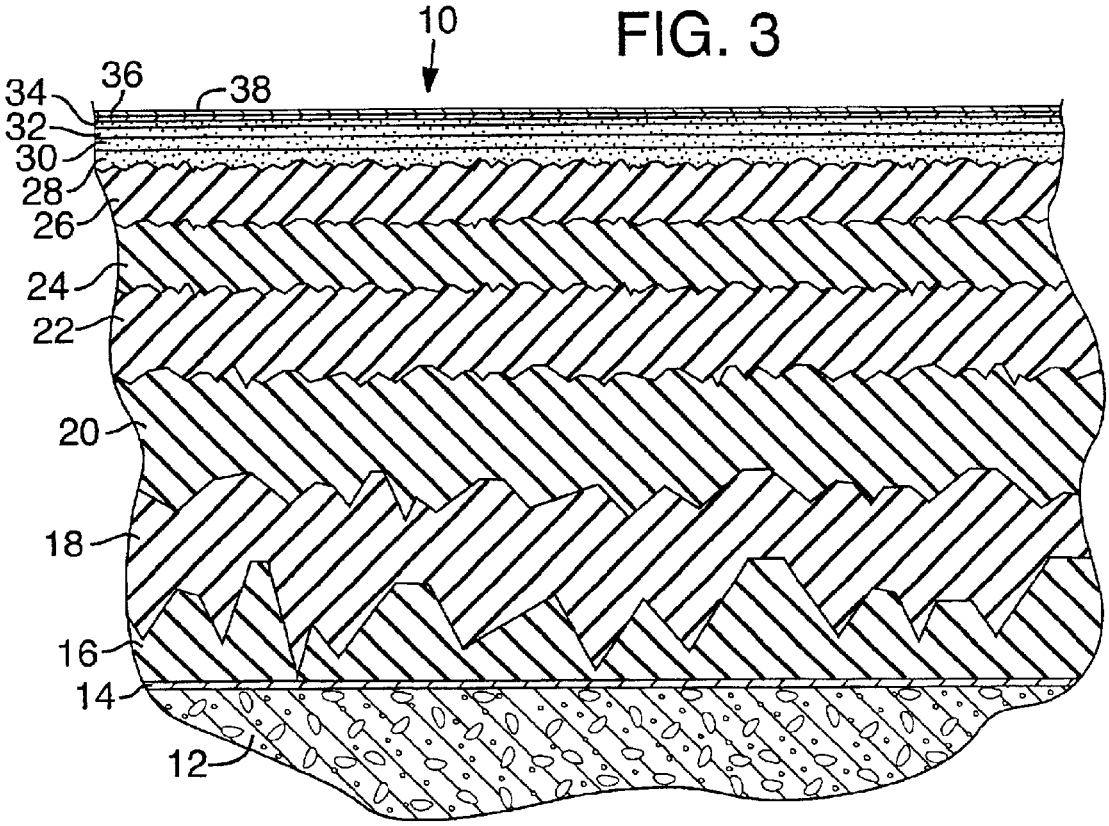
FIG. 3 is an enlarged and exaggerated cross-sectional view taken along line 3—3 of FIG. 2.

FIG. 1 shows the cushioned surface structure, indicated generally at 10, installed on a tennis court. FIGS. 2 and 3 illustrate the various layers of the surface structure 10. The illustrated surface structure 10 is formed on top of a base surface 12, which may comprise, for example, concrete or asphalt. An adhesive layer 14 comprising, for example, polyurethane, overlays the base surface 12. A first elastomeric layer 16 of dry elastomeric particles overlays the adhesive layer 14. A spray coating of acrylic binder (not shown) or other suitable adhesive may be applied over the first elastomeric layer 16.

Overlaying the first elastomeric layer 16 are second, third, fourth, fifth, and sixth elastomeric layers 18, 20, 22, 24, and 26, respectively, each of which comprises elastomeric particles mixed with an adhesive binder (which are referred to herein in other embodiments as "composite" layers). Each of the elastomeric layers 18, 20, 22, 24, and 26 may be applied on top of a spray coating of acrylic binder or other suitable adhesive (not shown).

Fill layers 28, 30, 32, and 34 consisting of dry fill material overlay the elastomeric layers to fill the voids in the elastomeric layers and provide a flat surface. Each fill layer 28, 30, 32, and 34 may be applied over a coating of acrylic binder or other suitable adhesive (not shown).

A tennis court coating-compound, such as a color-fill coating-system 36, overlays fill layer 34. The color-fill coating-system may comprise three separately applied layers of a color-fill mix. In one specific formulation, the color-fill mix includes acrylic resurface, acrylic binder, #70 silica sand and water. Finally, a color-coating system 38, comprising separately applied layers of a color-coating mix, is applied over the color-fill coating-system 36. The color-coating mix may comprise, for example, colored acrylic, acrylic binder, #120 silica base and water.

The elastomeric particles in the elastomeric layers 16, 18, 20, 22, 24, and 26 may be any suitable natural or synthetic elastomer. In particular embodiments, ground rubber from used automobile tires is used because it is readily available and relatively inexpensive compared to other types of elastomers. The fill material of fill layers 28, 30, 32, and 34 may be any mineral or granular material. Some examples of suitable fill materials include, without limitation, sand, aluminum oxide, or gravel.

In a working embodiment of the surface structure 10, the first elastomeric layer 16 comprises dry, loose ground rubber particles having a size of about 1 to 3 mm. FIG. 4 shows a magnified top view of the first elastomeric layer 16 having 1 to 3 mm ground rubber particles. The second, third, and fourth elastomeric layers 18, 20, and 22, respectively, comprise 1 to 3 mm rubber particles mixed with an acrylic binder. Accordingly, elastomeric layers 18, 20, and 22 may be referred to as "mix" layers or "rubber/acrylic mix" layers. FIG. 5 shows a magnified top view of such a mix layer having 1 to 3 mm rubber particles. The fifth and sixth elastomeric layers 24 and 26, respectively, comprise 0.5 to 1.5 mm rubber particles mixed with an acrylic binder, and also may be referred to as "mix" layers or "rubber/acrylic mix" layers. FIG. 6 shows a magnified top view of a mix layer having 0.5 to 1.5 mm rubber particles. In addition, fill layers 28 and 30 comprise #30 silica sand, and fill layers 32 and 34 comprise #70 silica sand.

In alternative embodiments, the surface structure 10 may include more or fewer elastomeric layers and/or fill layers than shown in the illustrated configuration to suit a particular application. For example, the surface structure 10 may include additional elastomeric layers to increase the overall resiliency of the surface. Conversely, fewer elastomeric layers may be used if a less resilient court is desired.

In the illustrated configuration, only the first elastomeric layer 16 is made of dry elastomeric particles (i.e., the elastomeric particles are not mixed with an adhesive binder); however, this is not a requirement. Accordingly, any combination of mix layers and layers of dry elastomeric particles may be used.

Turning to FIGS. 7–19, a method for forming the various layers of the surface structure 10 will now be described. The surface structure 10 may be formed on top of any suitable base surface, such as concrete or asphalt. The base surface is inspected for any irregularities and corrected if necessary before the playing surface is formed. The area to be surfaced in the illustrated example is 120 feet in length by 60 feet in width (7,200 sq. feet), which is the size of a standard tennis court. Thus, the specific quantities of materials used to form each layer of the surface structure in the following example must be adjusted accordingly to form a surface structure of a different size.

Figure 7:
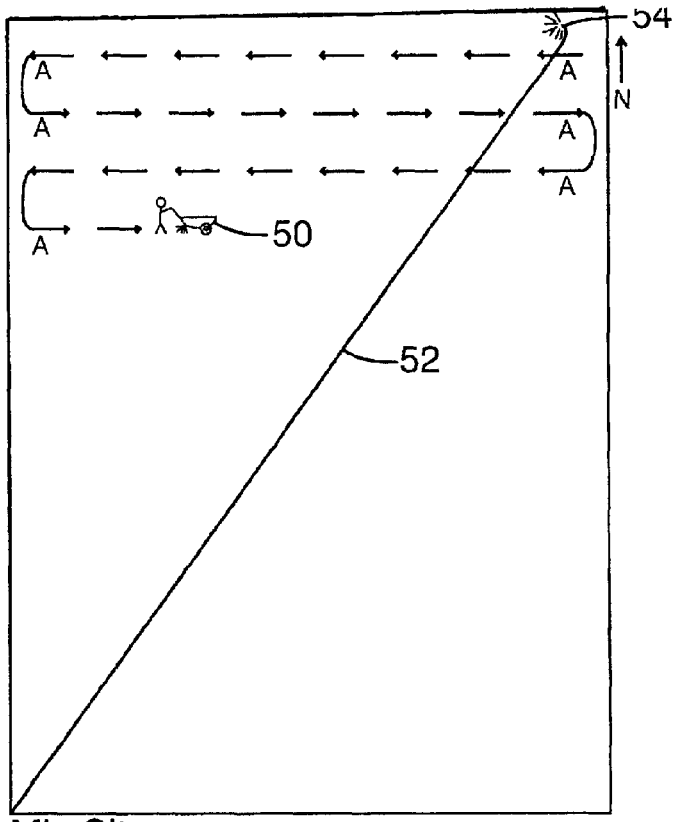
FIG. 7 is a top schematic view illustrating the application of ground rubber particles and a spray coating of acrylic binder on the area to be surfaced to form the first rubber layer of a tennis court.

Referring then to FIG. 7, there is shown the application of the first elastomeric layer 16 of the surface structure 10. First, about 20 gallons of 100 percent polyurethane may be spread over the base surface, such as with a conventional paint roller, to form the adhesive layer 14; then about 500 pounds of ground rubber particles approximately 1 to 3 mm in size are spread over the wet polyurethane. A conventional fertilizer spreader 50 may be used to spread the rubber particles. In one specific example, as shown in FIG. 1, the rubber particles are spread with the spreader 50 back and fourth across the width of the court starting, for example, in the northeast comer of the court and working toward the south end of the court (as indicated by arrows A).

Once the rubber particles are spread, an adhesive layer comprising, for example, an acrylic binder, is applied over the rubber particles. In the illustrated example, a pump (not shown) pumps acrylic binder through a hose 52 and through a nozzle 54 to spray the binder over the rubber particles. Approximately 50–60 gallons of the acrylic binder is sprayed over the rubber particles. The binder is then allowed to cure overnight. To facilitate curing of the binder, the binder is applied when the ambient air temperature is about 600° F. or greater.

Figure 8:
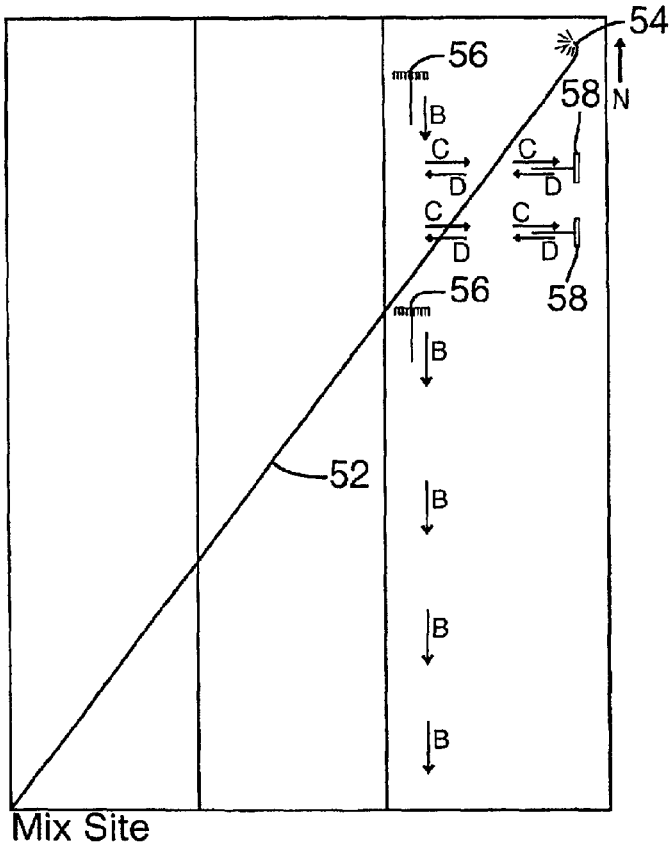
FIG. 8 is a top schematic view illustrating the application of a spray coating of acrylic binder and a rubber/acrylic binder mix to form the second rubber layer of the tennis court.

After the acrylic binder has cured, the second elastomeric layer 18 may be formed (as shown in FIG. 8). First, about 50–60 gallons of acrylic binder is sprayed over the previously formed first rubber layer. Immediately after the acrylic binder is sprayed, a layer of a ground rubber/acrylic binder mix is applied over the wet acrylic binder to form a rubber/acrylic mix layer.

The rubber/acrylic binder mix in this step comprises about 2,000 pounds of 1 to 3 mm rubber mixed with about 66 gallons (580.8 pounds) of acrylic binder to provide a rubber/acrylic binder mix layer having a rubber density of about 0.28 pounds of rubber per sq. foot. The mix may be formed in a conventional concrete mixer, in which case several batches of the mix are prepared to form the entire layer. When using a concrete mixer, about 150 pounds of rubber and 45 pounds of acrylic binder are used to form each batch of rubber/acrylic mix.

As shown in FIG. 8, the area to be surfaced may be divided lengthwise into approximately one-third sections for applying the Spray coating of acrylic binder and the mix layer. Sectioning of the court ensures that the mix layer adequately adheres to the sprayed layer of acrylic binder before the acrylic binder dries. The court may be divided into more or fewer sections depending on the ambient temperature.

In any case, to form the mix layer in each section, a batch of the rubber/acrylic mix is transferred from the mixer and deposited on a spray coating of wet acrylic binder such as with a wheelbarrow (not shown). The mix is spread evenly over the sprayed surface of the one-third section using, for example, a landscape rake 56. As indicated by arrows B in FIG. 8, the rubber/acrylic mix is spread over the length of the section with the teeth side of the rake 56 starting, for example, at the north end and working toward the south end of the section. After spreading the rubber/acrylic mix, the rake is pulled over the rubber/acrylic mix layer using the flat side of the rake to smooth out the rake lines.

Figure 9A:
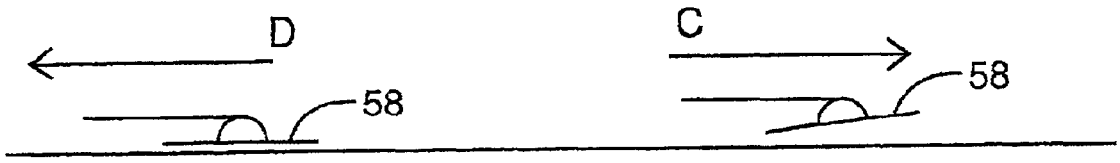
FIG. 9A is a schematic side view showing a method for troweling the rubber/acrylic mix layer of FIG. 8.

The rubber/acrylic mix layer is then troweled in a direction perpendicular to the direction of raking (i.e., across the width of the section) with a rectangular trowel 58, starting in the north end of the section and working toward the south end. As best shown in FIG. 9A, when troweling, it is desirable to push the trowel 58 over the rubber/acrylic mix layer in a first direction over about a four to six foot path (as indicated by arrows C) with the leading edge of the trowel tipped slightly up so that excess rubber particles are removed by the leading edge of the trowel. The trowel is then pulled back over the same path in the opposite direction (as indicated by arrows D) with the trowel in a level position to smooth the surface.

The process of spraying the acrylic binder and raking/troweling the rubber/acrylic mix layer is then repeated for the remaining one-third sections of the court to complete the second rubber layer. The rubber/acrylic mix layer of each section is allowed to cure before the next rubber layer is formed.

Figure 10:
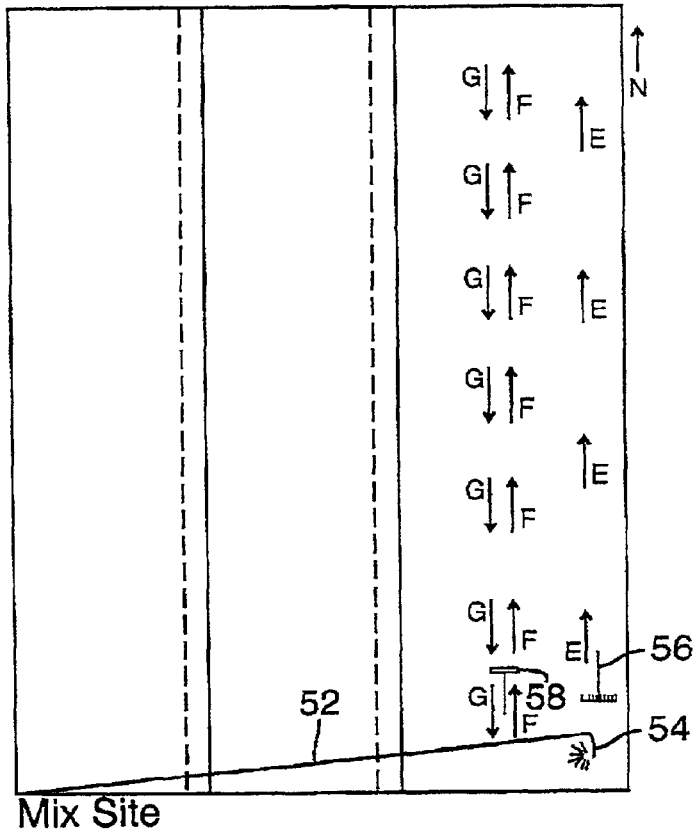
FIG. 10 is a top schematic view illustrating the application of another spray coating of acrylic binder and a rubber/acrylic binder mix to form the third rubber layer of the tennis court.

With reference to FIG. 10, there is shown the third elastomeric layer 20 being applied over the second elastomeric layer 18. As with the second elastomeric layer, the third elastomeric layer also comprises a spray coating of an acrylic binder (about 100 gallons for the entire area) and a rubber/acrylic mix layer overlaying the wet spray coating. As in the previous layer, the rubber/acrylic binder mix comprises about 2,000 pounds of 1 to 3 mm rubber and about 66 gallons of acrylic binder.

The area to be surfaced may again be divided lengthwise into approximately one-third sections, but with each section slightly overlapping the seams of the second rubber layer (as shown in dashed lines in FIG. 10). In this step, the surface of each section is finished south to north, i.e., in a direction opposite to the finishing direction of the last preceding layer. As shown, acrylic binder is sprayed onto a section of the court (about 33.3 gallons per section) and rubber/acrylic binder mix is deposited over the wet acrylic binder in the southern portion of the section. The flat side of the rake 56 is pulled in the direction of arrows E over the length of the section to evenly spread the rubber/acrylic binder mix over the section.

Figure 9B:
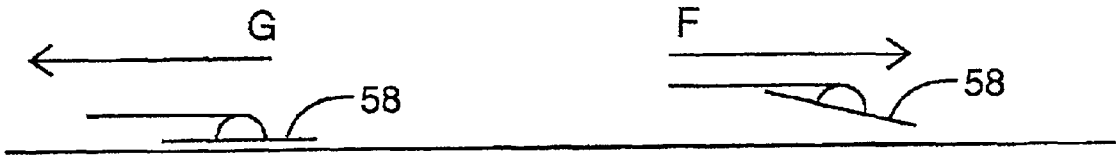
FIG. 9B is a schematic side view showing a method for troweling the third, fourth, fifth and sixth rubber layers.

The mix layer is then troweled with the trowel 58 over the length of the section (e.g., from south to north) to level the mix layer. As best shown in FIG. 9B, when traveling this layer, it is desirable to push the trowel in a first direction over a four to six foot path with the trailing edge slightly tipped up (as indicated by arrows F). The trowel is then pulled back over the same path at a level position (as indicated by arrows G). This procedure is repeated over the entire surface of the section to finish the section. The process of spraying acrylic binder, spreading the mix and the troweling the mix is then repeated for the remaining one-third sections to complete the third elastomeric layer.

After curing of the third elastomeric layer 20, the fourth elastomeric layer 22 is applied. As shown in FIG. 11, the court is divided into approximately one-quarter sections spanning the width of the court. Each section is finished across the width of the court (e.g., east to west) by first spraying a layer of acrylic binder, spreading a mix of 1 to 3 mm rubber and acrylic binder with the flat side of the rake to form a mix layer and then troweling the mix layer as described in connection with the third elastomeric layer 20 (FIG. 9B). In this layer, about 90 gallons of acrylic binder (about 22.5 gallons per section) is sprayed over the court. The mix comprises about 800 pounds of 1 to 3 mm rubber mixed with 16 gallons of binder (providing a rubber density of about 0.111 pounds per sq. foot).

Referring to FIG. 12, there is shown a fifth elastomeric layer 24 being formed over the cured fourth elastomeric layer 22. As with the previous layer, the fifth elastomeric layer 24 is formed in approximately one-quarter sections spanning the width of the court, but with each section slightly overlapping the seams of the fourth elastomeric layer 22. Each section is finished in the opposite direction from the previously formed fourth layer 22 (e.g., west to east) by first spraying a layer of acrylic binder, spreading a mix of rubber particles and acrylic binder with the flat side of the rake 56 over the wet acrylic binder to form a mix layer, and then troweling the mix layer as described in connection with the third elastomeric layer 20 (FIG. 9B). In the present layer, about 70 gallons of binder is sprayed over the entire surface (about 17.5 gallons per section). The mix for the entire surface comprises about 1250 pounds of 0.5 to 1.5 mm rubber particles and about 41 gallons of binder to provide a mix layer having a rubber density of about 0.174 pounds per sq. foot. The 0.5 to 1.5 mm rubber particles in the present layer fill the voids of the preceding layer of 1 to 3 mm rubber particles.

A sixth elastomeric layer 26 is formed over the cured fifth elastomeric layer 24. As shown in FIG. 13, the court is divided into approximately one-third sections spanning the length of the court. Each section is finished over the length of the court (e.g., north to south), first with a spray coating of acrylic binder and then with a mix of 0.5 to 1.5 mm rubber and acrylic binder over the wet spray coating of acrylic binder. The mix may be spread with the flat side of the rake 56 and troweled with trowel 58 using the technique shown in FIG. 9B. In this layer, a total of about 60 gallons of binder is sprayed over the entire surface (about 20 gallons per section) and the mix comprises about 900 pounds of 0.5 to 1.5 mm rubber and 30 gallons of binder to provide a mix layer with a rubber density of about 0.125 pounds per sq. foot.

FIG. 14 illustrates the application of fill layers 28 and 30 over the cured sixth elastomeric layer 26. Each of the fill layers 28 and 30 comprises a spray coating of binder covered with #30 silica sand. In working embodiments, number 30 silica sand has been found to be most effective in filling the voids of the previous rubber layer to provide a substantially smooth and flat finished playing surface. Although not required, white silica sand is preferred because its ability to reflect light facilitates the identification of surface imperfections, although other colors may also be used. In any event, to form fill layer 28, about 55 gallons of acrylic binder is sprayed over the entire area being surfaced. As the binder is being sprayed, #30 silica sand (approximately 1000 pounds) is deposited over the wet binder with the fertilizer spreader.

In one approach, the spreader 50 is pushed over a four foot path, pulled back over the same path, and then pushed forward again to cover another four foot path. This is repeated until all of the sand is spread evenly over the area being surfaced. As illustrated, the spray coating of binder and sand may be applied across the width of the court, starting, for example, at the northwest corner of the court and working toward the south end of the court (as indicated by arrows H). An optional spray coating of binder may be applied over the layer of sand. After the fill layer 28 has cured, it may be sanded with a floor sander (not shown) using 36 grit sand paper, after which the surface is blown or vacuumed to remove sanded particles.

Fill layer 30 is formed in a similar manner again using about 55 gallons of binder and about 1000 pounds of #30 silica sand. The spray coating of binder and sand are applied across the width of the court, however, this time starting in the northeast comer of the court and working toward the south end of the court. An optional spray coating of binder may be applied over the layer of sand. After fill layer 30 has cured, it is sanded and cleared of sanded particles by either blowing or vacuuming.

FIG. 15 illustrates the application of fill layers 32 and 34, each of which comprises a spray coating of binder covered with #70 silica sand. About 50 gallons of binder and 1000 pounds of sand are used in each of fill layers 32 and 34. The spray coating of binder and layer of sand of fill layer 32 may be applied in a manner similar to that described in connection with fill layers 28 and 30 except that the binder and sand are applied over the length of the court, starting, for example, in northeast corner of the court and working towards the west side of court (as indicated by arrows I). The spray coating of binder and layer of sand of fill layer 34 are also applied over the length of the court, however, this time starting in the southeast corner of the corner and working toward the west side of the court. At this stage an optional spray coating of binder may be applied on top of each layer of sand. Finally, each silica sand layer is sanded with a floor sander and cleared of sanded particles after it has cured.

Referring to FIG. 16, a color-fill coating-system 36 is applied over fill layer 34. The color-fill coating-system 36 in this example comprises at least three separately applied layers of a color-fill mix. The mix for the first of the three layers comprises about 68 gallons of acrylic resurface, 40 gallons of acrylic binder, 900 pounds of #70 silica sand and 25 gallons of water. The color-fill coating-system 36 fills the surface over the silica sand layers to provide a conventional playing surface. The ingredients for the mix may be prepared in a conventional mortar mixer. The color-fill mix is spread evenly back and fourth across the width of the court, such as with a squeegee 60, starting at the north end of the court and working toward the south end (as indicated by arrows J). After the first layer of the color-fill mix has dried, it is sanded using a floor sander having 36 grit sandpaper and cleaned by either blowing or vacuuming.

The amount of each ingredient of the color-fill mix is reduced by about 25 percent for the second layer of the color-fill coating-system. Accordingly, the mix for the second color-fill mix layer comprises about 51 gallons of acrylic resurface, 30 gallons of acrylic binder, 675 pounds of #70 silica sand and 18.75 gallons of water. As indicated by arrows K, the mix is then applied with the squeegee 60 following a path that is directly opposite to the path taken to apply the first layer of color-fill mix (i.e., spreading the mix across the width of the court, starting at the south end and working toward the north end). The dried second layer is sanded and cleaned as previously described.

The amount of each ingredient of the color-fill mix is further reduced by about 25 percent for the third layer of the color-fill coating-system 36. The third layer is desirably applied in a direction perpendicular to the direction of the first and second layers of the color-fill coating. For example, the color-fill mix may be spread across the length of the court, starting, for example, at the east side of the court and working toward the west side (as shown by arrows L). This layer is also sanded and cleaned after it has been allowed to dry. If desired, additional layers may be added to the color-fill coating-system in a similar manner.

Next, a multi-layered color-coating system 38 is applied over the color-fill coating-system 36. The color-coating system 38 in this example comprises four separately applied layers of a color-coat mix. However, more or fewer layers may be applied depending on the preference of the end user. More layers will produce a harder and faster playing surface. Conversely, fewer layers will produce a relatively softer and slower surface.

Figure 17:
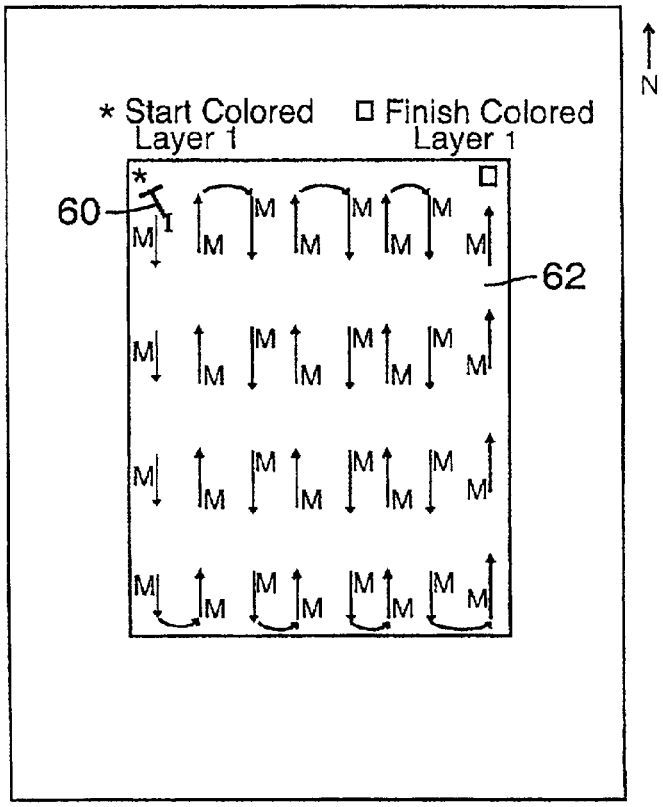
FIG. 17 is a top schematic view showing the application of the color-coating being applied in the playing area of the tennis court.

If, as illustrated in FIG. 17, a two-color tennis court is desired, playing area 62 is marked off and the color-coating system 38 is applied first in the playing area. The mix for the first layer of the color-coating system 38 comprises about 15 gallons of colored acrylic, 10 gallons of acrylic binder, 15 gallons of #120 silica base and 8 gallons of water. The ingredients for the mix may be prepared in a conventional cement mixer and transported to the court with a wheelbarrow. The mix is spread back and fourth across the length of the playing area 62 with a squeegee starting at the east side of the playing area 62 and working toward the west side (as shown by arrows M).

The mix ingredients are reduced by about 20 percent for each subsequently added color layer. Accordingly, the mix for the second layer of the color-coating system 38 comprises about 12 gallons of colored acrylic, 8 gallons of acrylic binder, 12 gallons of #120 silica base and 6.4 gallons of water. The second layer is applied in the opposite direction of the arrows M (i.e., across the length of the playing area 62 starting at the west side and working toward the east).

The mix for the third color layer of the color-coating system 38 is further reduced by 20 percent. This layer may be applied in a direction perpendicular to the application of the first and second layers of the color-coating system 38. In other words, the third layer may be spread back and fourth across the width of the playing area starting, for example, at the north end and working toward the south. Finally, the fourth layer of the color-coating system 38, the mix of which is again reduced by another 20 percent, may be applied in the opposite direction of the previously applied third layer (i.e., across the width of the playing area 62 but starting in the south end and working toward the north).

Figure 18:
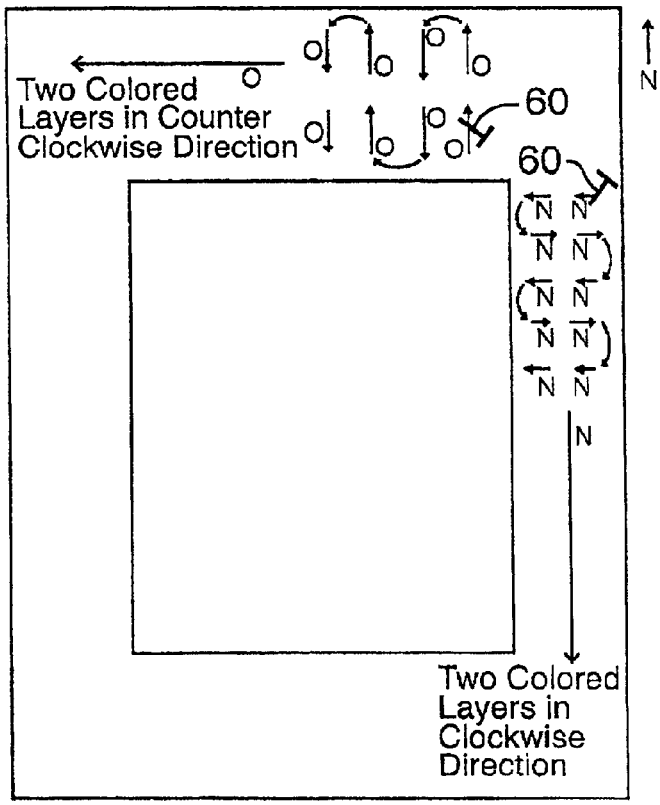
FIG. 18 is a top schematic view showing the application of the color-coating being applied in the area surrounding the playing area.

After the layers of the color-coating system 38 are applied within the playing area 62, four layers of color-coat mix are applied in the area surrounding the playing area 62 (as shown in FIG. 18). The mix for each layer applied in this area is the same as in the previous step (i.e., 15 gallons of colored acrylic, 10 gallons of acrylic binder, 15 gallons of #120 silica base and 8 gallons of water for the first layer and then reduced by about 20 percent for each subsequent layer). As shown in FIG. 18, two layers of color-coat mix are applied with the squeegee 60 in the clockwise direction around the playing area 62 (as indicated by arrows N) and two layers of color-coat mix are applied in the counter clockwise direction (as indicated by arrows O).

Of course, if only one color is used on the court, the quantities specified above for each layer of color-coat mix are doubled to cover the entire court surface. For example, the mix for the first layer in such a case comprises 30 gallons of colored acrylic, 20 gallons of acrylic binder, 30 gallons of #120 silica base and 16 gallons of water. The ingredients in each subsequent layer are reduced by about 20 percent.

After the color-coating system 38 has been applied, lines may be added to the finished surface (as shown in FIG. 1). In one approach, tape is laid on the surface to mark off the lines. Primer is applied between the lines, and two coats of line paint is applied over the primer.

The method described above, and in particular, the method of alternating directions in finishing each successive rubber and silica sand layer, is most effective in filling the voids of each layer to provide a substantially smooth and flat finished playing surface. Nonetheless, the playing surface may be formed using alternative methods or techniques.

Any commercially available acrylic binder may be used in the preceding example. Some manufacturers of acrylic binders include Specialty Polymers Co. (product #N610), California Products Co. (product #4170 and 4125), and Malard Creek Polymers. California Products Co. also manufactures suitable colored acrylic paint and a #120 silica base to form the layers of color-coating system 38 in the above example.

In addition, rubber particles of different sizes can be substituted for those used in the above example. For example, instead of using 1 to 3 mm rubber in the first, second, third and fourth rubber layers, 1 to 4 mm rubber or 1 to 5 mm could be used.

The above example is for a regulation tennis court. In the example, the ingredient amounts required for a given layer may vary considerably depending on air temperature and other climatic conditions.

The invention has been described with respect to particular embodiments and modes of action for illustrative purposes only. The present invention may be subject to many modifications and changes without departing from the spirit or essential characteristics thereof. I therefore claim as my invention all such modifications as come within the scope of the following claims.

I claim:

1. A cushioned surface structure comprising:

at least one elastomeric layer comprising at least 5% by weight of elastomeric particles;

at least one fill layer consisting of dry fill material applied over the elastomeric layer to fill voids between the elastomeric particles; and a coating-compound applied over the fill layer.

2. The surface structure of claim 1, wherein the at least one elastomeric layer includes an elastomeric layer comprised entirely of loose elastomeric particles.

3. The surface structure of claim 1, wherein the at least one elastomeric layer includes an elastomeric layer comprising a mix layer of elastomeric particles mixed with a binder.

4. The surface structure of claim 1, wherein an adhesive layer is applied over the at least one elastomeric layer and the at least one fill layer is applied over and adheres to the adhesive layer.

5. The surface structure of claim 1, wherein the at least one fill layer includes a fill layer consisting of dry silica sand.

6. The surface structure of claim 1, wherein the at least one elastomeric layer comprises at least two elastomeric layers, including a first elastomeric layer and a second elastomeric layer, the first elastomeric layer comprising elastomeric particles and the second elastomeric layer comprising elastomeric particles and overlaying the first elastomeric layer, and wherein the at least one fill layer overlays the second elastomeric layer.

7. The surface structure of claim 6, wherein the second elastomeric layer comprises a matrix of elastomeric particles and an adhesive binder.

8. The surface structure of claim 6, wherein the elastomeric particles of the first elastomeric layer are generally larger in size than the elastomeric particles of the second elastomeric layer.

9. The surface structure of claim 6, wherein the density of elastomeric particles is greater in the first elastomeric layer than in the second elastomeric layer.

10. The surface structure of claim 6, wherein the elastomeric particles of the first elastomeric layer are generally larger in size than the elastomeric particles of the second elastomeric layer, and the density of elastomeric particles is greater in the first elastomeric layer than in the second elastomeric layer.

11. The surface structure of claim 1, wherein the at least one fill layer comprises at least two fill layers, including a first fill layer and a second fill layer, the first fill layer overlaying the at least one elastomeric layer and the second fill layer overlaying the first fill layer, the first and second fill layers consisting of dry fill material.

12. The surface structure of claim 11, wherein the fill material in the first fill layer has a particle size that is generally larger than the particle size of the fill material in the second fill layer.

13. The surface of claim 12, wherein the first fill layer consists of #30 silica sand and the second fill layer consists of #70 silica sand.

14. The surface structure of claim 1, wherein the at least one elastomeric layer comprises a first elastomeric layer, a second elastomeric layer overlaying the first elastomeric layer, a third elastomeric layer overlaying the second elastomeric layer, a fourth elastomeric layer overlaying the third elastomeric layer, and a fifth elastomeric layer overlaying the fourth elastomeric layer, each of the first, second, third, fourth and fifth elastomeric layers comprising elastomeric particles.

15. The surface structure of claim 14, wherein the first elastomeric layer consists of rubber particles having a size of about 1 to 5 mm, the second and third elastomeric layers comprise ground rubber particles having a size of about 1 to 5 mm mixed with an adhesive binder, and the fourth and fifth elastomeric layers comprise ground rubber particles having a size of about 0.5 to 1.5 mm mixed with an adhesive binder.

16. The surface structure of claim 1, further comprising a color-fill layer overlaying the at least one fill layer.

17. The surface structure of claim 16, further comprising a color-coating layer overlaying the color-fill layer.

18. A cushioned surface structure comprising:

at least one elastomeric layer comprising elastomeric particles;

a first fill layer overlaying the elastomeric layer, the first fill layer consisting of dry fill material;

a second fill layer overlaying the first fill layer, the second fill layer consisting of dry fill material, wherein the fill material of the first fill layer has a particle size that is generally larger than the particle size of the fill material of the second fill layer; and a coating-compound layer applied over the second fill layer.

19. The surface structure of claim 18, further comprising at least one composite layer interposed between the at least one elastomeric layer and the first fill layer, the composite layer comprising elastomeric particles mixed with an adhesive binder.

20. The surface structure of claim 19, wherein the elastomeric particles of the at least one elastomeric layer are generally larger than the elastomeric particles of the at least one composite layer.

21. The surface structure of claim 19, wherein the at least one composite layer includes at least one lower composite layer and one upper composite layer interposed between the at least one elastomeric layer and the first fill layer, each of the upper and lower composite layers comprising elastomeric particles mixed with an adhesive binder, wherein the elastomeric particles of the lower composite layer are generally larger than the elastomeric particles of the upper composite layer.

22. The surface structure of claim 21, wherein the elastomeric particles of the lower composite layer comprise rubber particles having a size of about 1 to 5 mm and the elastomeric particles of the upper composite layer comprise rubber particles having a size of about 0.5 to 1.5 mm.

23. The surface structure of claim 18, wherein an adhesive layer is applied over the first fill layer and the second fill layer is applied over and adheres to the adhesive layer.

24. The surface structure of claim 23, wherein the first fill layer comprises #30 silica sand and the second fill layer comprises #70 silica sand.

25. A cushioned surface structure comprising:

at least one elastomeric layer comprising elastomeric particles;

a first fill layer overlaying the elastomeric layer, the first fill layer consisting of dry fill material;

a second fill layer overlaying the first fill layer, the second fill layer consisting of dry fill material, wherein the fill material of the first fill layer has a particle size that is generally larger than the particle size of the fill material of the second fill layer; and wherein a color-fill layer overlays the second fill layer.

26. The surface structure of claim 25, wherein the color-fill layer comprises acrylic resurface, acrylic binder, silica sand and water.

27. The surface structure of claim 25, wherein a color-coating layer overlays the color-fill layer.

28. A cushioned, surface structure comprising:

a first elastomeric layer comprising elastomeric particles;

a second elastomeric layer overlaying the first elastomeric layer, the second elastomeric layer comprising elastomeric particles that are generally smaller in size than the elastomeric particles of the first elastomeric layer;

at least one fill layer overlaying the second elastomeric layer for filling voids in the elastomeric layers; and a coating-compound layer overlaying the at least one fill layer.

29. The surface structure of claim 28, wherein at least one of the first and second elastomeric layers comprises elastomeric particles mixed with an adhesive binder.

30. The surface structure of claim 28, wherein the first and second elastomeric layers comprise at least 50% by weight of elastomeric particles.

31. The surface structure of claim 28, wherein the at least one fill layer comprises a first fill layer and a second fill layer with an adhesive layer interposed between the first fill layer and the second fill layer, the first and second fill layers comprising fill material, the size of the fill material in the first fill layer having a particle size that is generally larger than the particle size of the fill material of the second fill layer.

32. The surface structure of claim 28, wherein the first elastomeric layer consists of rubber particles, the first elastomeric layer being formed such that there is about 0.07 lbs./ft$^2$ of rubber particles.

33. The surface structure of claim 28, wherein the second elastomeric layer comprises about 70 to 85% by weight of rubber particles and 15 to 30% by weight of an adhesive binder.

34. The surface structure of claim 28, wherein the density of elastomeric particles is greater in the first elastomeric layer than in the second elastomeric layer.

35. A method of forming a cushioned surface structure, the method comprising:

forming at least one elastomeric layer comprising at least 5% by weight of elastomeric particles;

applying at least one fill layer over the at least one elastomeric layer, the fill layer consisting of dry fill material having a particle size that is smaller than the elastomeric particles such that the fill material fills voids between the elastomeric particles; and applying a coating-compound over the at least one fill layer.

36. The method of claim 35, wherein the fill layer consists of dry silica sand.

37. The method of claim 35, wherein applying at least one fill layer over the elastomeric layer comprises applying a first fill layer consisting of dry fill material over the elastomeric layer, applying an adhesive layer over the first fill layer, and applying a second fill layer consisting of dry fill material over the adhesive layer while the adhesive layer is still wet.

38. The method of claim 35, wherein the coating-compound comprises a color-fill coating.

39. The method of claim 35, wherein forming at least one elastomeric layer comprises forming a first elastomeric layer of elastomeric particles and forming a second elastomeric layer of elastomeric particles over the first elastomeric layer.

40. The method of claim 39, wherein the density of rubber particles is greater in the first elastomeric layer than in the second elastomeric layer.

41. The method of claim 35, wherein forming at least one elastomeric layer comprises mixing elastomeric particles with a binder to form a mixture and then forming an elastomeric layer from the mixture.

42. The method of claim 39, wherein the elastomeric particles of the first elastomeric layer are generally larger in size than the elastomeric particles of the second elastomeric layer.

43. A method of forming a cushioned surface structure on an existing sub-surface, the method comprising:

applying at least a lower elastomeric layer lover the sub-surface, the lower elastomeric layer comprising elastomeric particles;

applying at least an upper elastomeric layer over the lower elastomeric layer, the upper elastomeric layer comprising elastomeric particles that are generally smaller in size than the particles of the lower elastomeric layer;

applying at least one fill layer over the upper elastomeric layer for filling the voids in the elastomeric layers applying a coating-compound over the at least one fill layer.

44. The method of claim 43, wherein the lower elastomeric layer is applied in a first direction over the sub-surface and the upper elastomeric layer is applied over the lower elastomeric layer in a second direction that is generally perpendicular to the first direction.

45. The method of claim 43, wherein applying at least one fill layer comprises applying an adhesive layer over the upper elastomeric layer and applying at least one fill layer over the adhesive layer while the adhesive layer is still wet.

46.The method of claim 43, further comprising applying an adhesive layer over the at least one fill layer and applying another fill layer over the adhesive layer while the adhesive layer is still wet.

47. The method of claim 43, wherein the at least one fill layer consists of dry silica sand.

48. The method of claim 43, wherein applying at least one fill layer comprises applying a first fill layer consisting of dry silica sand over the upper elastomeric layer, applying an adhesive layer over the first fill layer, and applying a second fill layer consisting of dry silica sand over the adhesive layer while the adhesive layer is still wet.

49. The method of claim 48, wherein the silica sand of the first fill layer has a particle size that is generally larger than the particle size of the silica sand of the second fill layer.

50. A cushioned surface structure for covering an underlying sub-surface, comprising:

an elastomeric layer comprising elastomeric particles overlying the sub-surface;

a composite layer overlying the elastomeric layer, the composite layer comprising a matrix of elastomeric particles and a binder;

an adhesive layer covering the composite layer;

a fill layer overlying the composite layer and adhering to the adhesive layer;

a color-fill layer overlying the fill layer; and a color-coating layer overlying and adhering to the color-fill layer.

51. A method of forming a cushioned surface structure on an underlying sub-surface, the method comprising:

applying an elastomeric layer of elastomeric particles over the sub-surface;

applying a composite layer over the elastomeric layer, the composite layer comprising a matrix of elastomeric and a binder;

applying an adhesive layer over the composite layer;

applying a fill layer over the adhesive layer while the adhesive layer is still wet;

applying a color-fill layer over the fill layer; and applying a color-coating layer over the color-fill layer.

* * * * *

UNITED STATES PATENT AND TRADEMARK OFFICE

CERTIFICATE OF CORRECTION

PATENT NO. : 6,786,674 B1
DATED : September 7, 2004
INVENTOR(S) : Daniel B. Hanks It is certified that error appears in the above-identified patent and that said Letters Patent is hereby corrected as shown below:

Column 3,
Line 54, “mmn” should be -- mm --.

Column 4,
Line 36, “following g” should be -- follow --.

Column 6,
Line 17, “600ºF” should be -- 60ºF --.

Column 7,
Line 32, “traveling” should be -- troweling --.
Line 39, “the troweling the mix” should be -- troweling the mix --.

Column 8,
Line 58, “comer” should be -- corner --.

Column 9,
Line 8, “corner” should be -- court --.

Signed and Sealed this

Nineteenth Day of April, 2005

JON W. DUDAS
*Director of the United States Patent and Trademark Office*